US008416163B2

(12) United States Patent
Yun

(10) Patent No.: US 8,416,163 B2
(45) Date of Patent: Apr. 9, 2013

(54) LIQUID CRYSTAL PANEL AND LIQUID CRYSTAL DISPLAY DEVICE HAVING THE SAME

(75) Inventor: Jae Kyeong Yun, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1463 days.

(21) Appl. No.: 11/397,557

(22) Filed: Apr. 5, 2006

(65) Prior Publication Data

US 2006/0227089 A1 Oct. 12, 2006

(30) Foreign Application Priority Data

Apr. 6, 2005 (KR) ..... 10-2005-0028404
Apr. 3, 2006 (KR) ..... 10-2006-0030235

(51) Int. Cl.
*G09G 3/36* (2006.01)

(52) U.S. Cl.
USPC ..... 345/87; 345/92

(58) Field of Classification Search ..... 345/49, 345/96, 98, 141, 90, 92, 8, 7; 349/77, 37
See application file for complete search history.

(56) References Cited

U.S. PATENT DOCUMENTS 4,345,249 A * 8/1982 Togashi ..... 345/90
5,926,158 A * 7/1999 Yoneda et al. ..... 345/98
7,450,098 B2 11/2008 Lee et al.
2001/0026331 A1* 10/2001 Oota et al. ..... 349/43
2001/0028422 A1* 10/2001 Tsujimura et al. ..... 349/96
2002/0131006 A1* 9/2002 Yang ..... 349/141
2002/0154084 A1* 10/2002 Tanaka et al. ..... 345/92
2005/0001808 A1* 1/2005 Lee ..... 345/96

FOREIGN PATENT DOCUMENTS

| | | | |
|---|---|---|---|
| CN | 03155035 | | 7/2003 |
| JP | 07-168204 | | 7/1995 |
| JP | 09-33943 | * | 2/1997 |
| JP | 10-031229 | | 2/1998 |
| JP | 10031229 A | * | 2/1998 |
| TW | 511061 | | 11/2002 |
| TW | 591573 | | 6/2004 |

* cited by examiner

*Primary Examiner* — Chanh Nguyen
*Assistant Examiner* — Allison Walthall
(74) *Attorney, Agent, or Firm* — McKenna Long & Aldridge LLP

(57) ABSTRACT

A liquid crystal panel is disclosed that minimizes driving power consumption. The liquid crystal panel includes a plurality of gate lines and a plurality of data lines defining pixel regions. Pixels are arranged in the pixel regions and respond to signals from corresponding gate lines, corresponding data lines, and previous pixels adjacent the data lines. Accordingly, since the swing width of the pixel voltage signals supplied to the data lines is reduced, the driving power consumption can be reduced and impulse type noise can be suppressed.

11 Claims, 7 Drawing Sheets

Fig. 2A (Related Art)

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

Fig. 2B (Related Art)

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

LIQUID CRYSTAL PANEL AND LIQUID CRYSTAL DISPLAY DEVICE HAVING THE SAME

CROSS-REFERENCE TO RELATED APPLICATION

This application claims the benefit of the Korean Patent Application Nos. 10-2005-028404, filed on Apr. 6, 2005, and 10-2006-0030235, filed on Apr. 3, 2006, which are hereby incorporated by reference for all purposed as if fully set forth herein.

BACKGROUND OF THE INVENTION

1. Field of the Invention

The present invention relates to a flat panel for displaying an image, and more particularly, to a liquid crystal panel. Also, the present invention relates to a liquid crystal display device (LCD) having a liquid crystal panel and a driving method thereof.

2. Description of the Related Art

Related Art flat panels such as a liquid crystal panel, a plasma display panel, a light emitting display panel and so on are advantageous because of their lightweight and slim profile. These flat panels are and they are replacing cathode ray tubes (CRTs). In the liquid crystal panel, an electric field varying with pixel data of video signals is applied to each pixel. Due to the applied electric field, light transmittance of liquid crystal cells is adjusted and then images are displayed.

Liquid crystal cells included respectively in the liquid crystal panel are commonly connected to a common voltage line. Therefore, the respective liquid crystal cells are charged with pixel voltage signals varying with respect to a common voltage. In other words, the pixel voltage signal supplied to the liquid crystal cell has a difference voltage from the common voltage. Thus, the related art liquid crystal panel dissipates a large amount of driving power.

Also, the related art liquid crystal panel is driven in an inversion system so as to improve a response characteristic of liquid crystal with respect to the pixel voltage signal. The inversion driving system includes a frame inversion system, a line (or column) inversion system, and a dot inversion system. The frame inversion system inverts the polarity of the pixel voltage signal according to the change of frames, and the line (or column) inversion system inverts the polarity of the pixel voltage signal according to the change of lines. The dot inversion system inverts the polarity of the pixel voltage signal according to the change of pixels. According to these inversion driving systems, positive pixel voltage signals and negative voltage signals may be applied to the liquid crystal panel at the same time. Here, the positive pixel voltage signals represent signals that vary in a positive polarity (+) region with respect to the common voltage, and the negative pixel voltage signals represent signals that vary in a negative polarity (−) region with respect to the common voltage. Hence, a swing width of the pixel voltage signal applied to the liquid crystal panel increases. Consequently, in the case of the liquid crystal panel driven by the inversion driving system, impulse type noises are generated and the driving power consumption increases.

These problems will be described in more detail with reference to FIG. 1. FIG. 1 is a schematic view of a related art LCD. In FIG. 1, the related art LCD includes a liquid crystal panel 2 connected to a gate driver 4 and a data driver 6. The liquid crystal panel 2 has a plurality of pixels PXL at regions defined by crossings of a plurality of data lines DL1 to DLm and a plurality of gate lines GL1 to GLn. Each of the pixels includes a liquid crystal cell CLC and a thin film transistor (TFT). The liquid crystal cell CLC is connected to a common voltage line Vcom extending from a common voltage generator 9, and the TFT switches a pixel voltage signal supplied from a corresponding data line DL to the liquid crystal cell CLC in response to a scan signal of a corresponding gate line GL. Because the liquid crystal cell CLC of the pixel PXL is connected to the common voltage line Vcom, the pixel voltage signal supplied to the liquid crystal cell CLC has a difference voltage from the common voltage Vcom. Hence, the pixel voltage charged at each liquid crystal cell and the swing width of the pixel voltage signal output to each data line DL increases. Consequently, the related art liquid crystal panel has high driving power consumption.

In addition, the pixels PXL of the liquid crystal panel 2 can be driven by the inversion system. For example, as illustrated in FIGS. 2A and 2B, each of the pixels can be driven by a pixel voltage signal in which the polarity is inverted for each frame. Also, the polarity is inverted with respect to the pixel voltage supplied to adjacent pixels. FIG. 2A illustrates polarity patterns of the pixel voltage signal supplied to each pixel of the liquid crystal panel 2 when images of odd (or even) frames are displayed, and FIG. 2B illustrates polarity patterns of the pixel voltage signal supplied to each pixel of the liquid crystal panel 2 when images of even (or odd) frames are displayed. To supply the polarity-inverted pixel voltage signals to the adjacent pixels at each frame, the data driver 6 converts pixel data from the timing controller 8 into analog pixel voltage signals and inverts the polarity of the converted pixel voltage signals at each frame and horizontal sync period according to the data lines DL1 to DLm. Therefore, if the pixel voltage signal supplied to the data lines DL1 to DLn has a positive voltage during one frame or one horizontal sync period as illustrated in FIG. 3, it has a negative voltage during a next frame or next horizontal sync period.

As described above, if the liquid crystal panel is driven by the inversion system, the pixel voltage signal alternately has a positive voltage and a negative voltage with respect to the common voltage and the swing width also increases. Consequently, the related art liquid crystal panel and the LCD having the same have problems of driving power consumption increases and the occurrence of impulse type noise.

SUMMARY OF THE INVENTION

Accordingly, the present invention is directed to a liquid crystal panel and an LCD having the same that substantially obviate one or more problems due to limitations and disadvantages of the related art.

An advantage object of the present invention is to provide a liquid crystal panel suitable to minimize driving power consumption.

Another advantage of the present invention is to provide a liquid crystal panel suitable to suppress the occurrence of noise.

A further advantage of the present invention is to provide an LCD and a driving method thereof suitable to minimize driving power consumption.

A still further another advantage of the present invention is to provide an LCD and a driving method thereof suitable to suppress the occurrence of noise.

Additional advantages and features of the invention will be set forth in part in the description which follows and in part will be apparent from the description, to those having or may be learned by practice of the invention. These and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a liquid crystal panel including: a plurality of gate lines; a plurality of data lines defining pixel regions at crossings of the gate lines; and pixels arranged in the pixel regions and responsive to signals from the corresponding gate lines, the corresponding data lines, and previous pixels adjacent along the data lines.

In another aspect of the present invention, there is provided a liquid crystal panel including: a plurality of gate lines; a plurality of data lines defining pixel regions at crossings of the gate lines; liquid crystal cells arranged in the pixel regions and serially connected along the data lines; and control switching elements arranged in the pixel regions and connected among the gate lines, the data lines, and the liquid crystal cells.

In a further another aspect of the present invention, there is provided a liquid crystal display device including: a gate driver sequentially driving gate lines arranged on a liquid crystal panel; and a data driver supplying a second pixel voltage signal to data lines of the liquid crystal panel when a next gate line is driven, the second pixel voltage signal being based on a first pixel voltage signal when a previous gate line of adjacent gate lines is driven as a reference voltage.

In a still further aspect of the present invention, there is provided a driving method of a liquid crystal display device, including: sequentially driving gate lines arranged on a liquid crystal panel; supplying a first pixel voltage signal of a previous gate line of adjacent lines to data lines arranged on the liquid crystal panel; and supplying a second pixel voltage signal to the data lines when a next gate line is driven, the second pixel voltage being based on the first pixel voltage as a reference voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings:

FIGS. 2A and 2B illustrate inversion driving systems of the related art LCD;

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
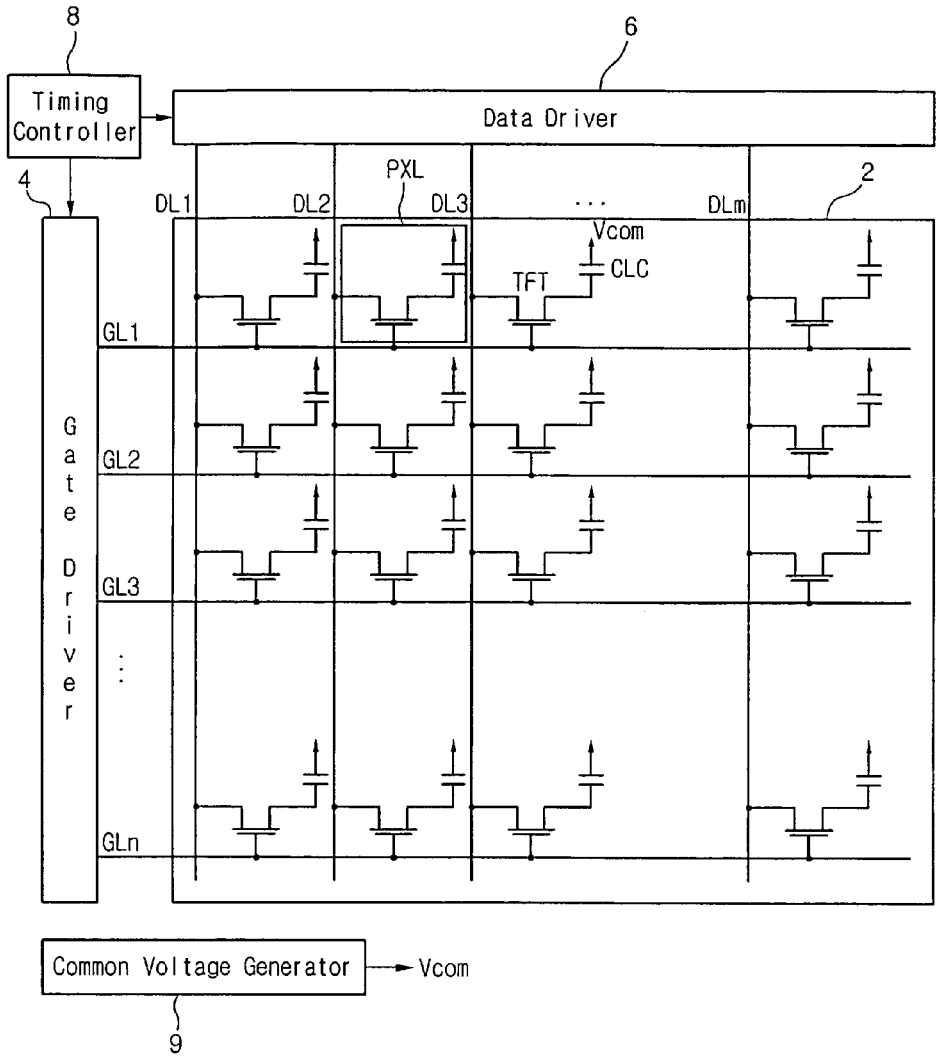
Fig. 1 (Related Art)
FIG. 1 is a schematic view of a related art LCD.
Figure 3:
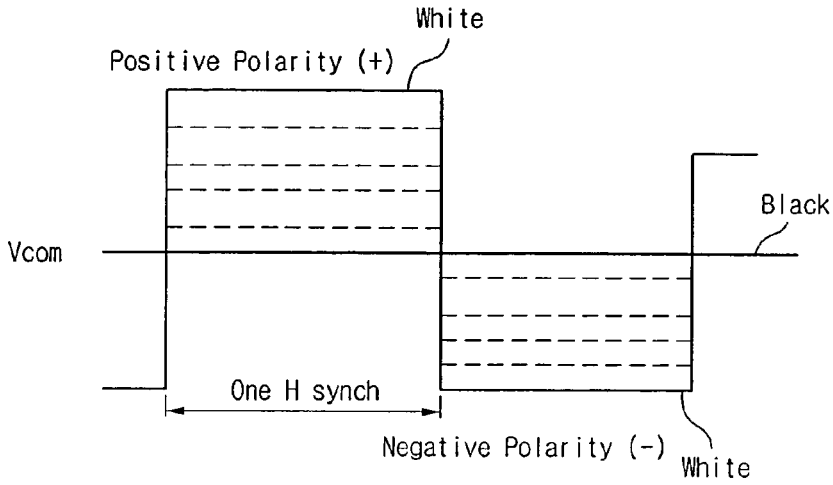
Fig. 3 (Related Art)
FIG. 3 is a waveform diagram illustrating the change of voltage charged to a pixel of a liquid crystal panel driven by the inversion system.
Figure 4:
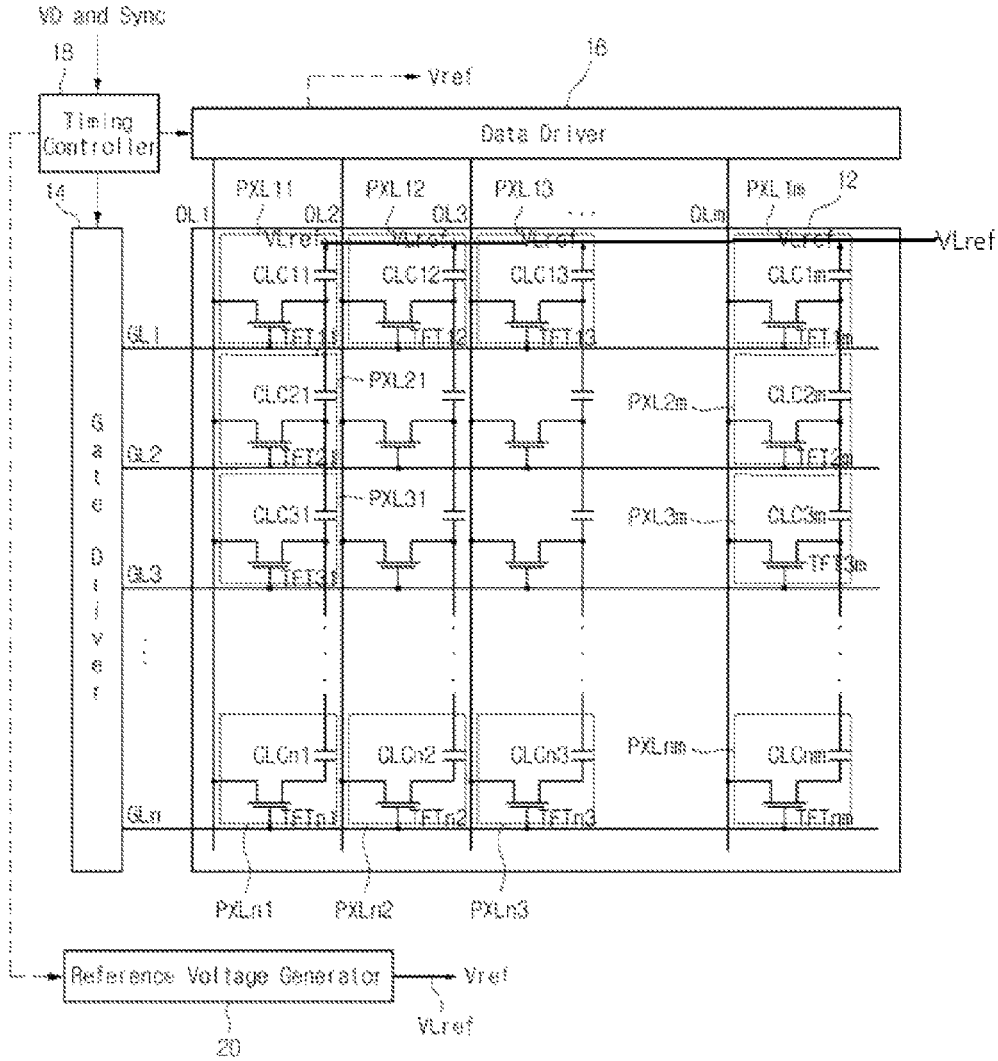
FIG. 4 is a schematic view of an LCD according to an embodiment of the present invention.
Figure 5:
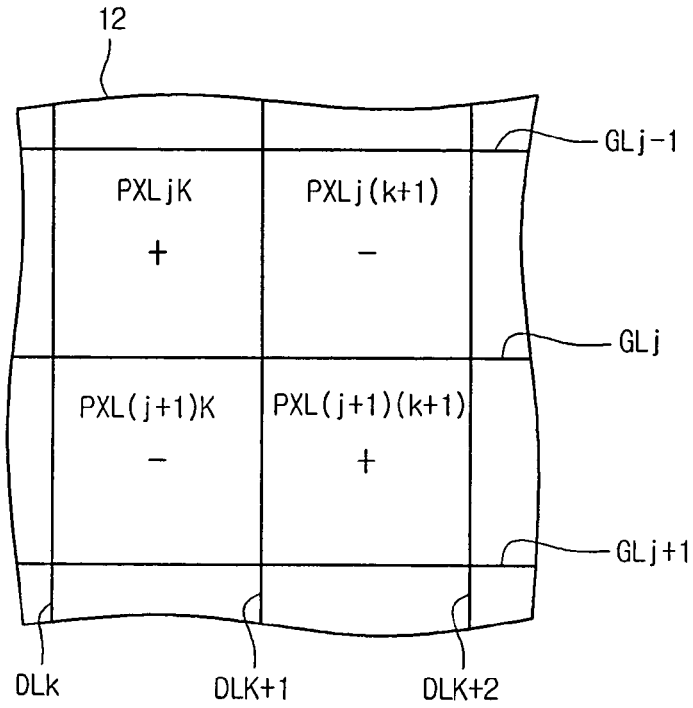
FIG. 5 illustrates polarity pattern of pixel voltages charged to pixels of a liquid crystal panel according to an embodiment of the present invention when the liquid crystal panel is driven by a dot inversion system.

FIG. 4 is a schematic view of an LCD according to an embodiment of the present invention, and FIG. 5 illustrates a polarity pattern of pixel voltages charged to pixels of a liquid crystal panel according to an embodiment of the present invention, when the liquid crystal panel is driven by a dot inversion system.

In FIG. 4, the LCD according to the present invention includes a liquid crystal panel 12 driven by a gate driver 14 and a data driver 16. The liquid crystal panel 12 has a plurality of pixels PXL11 to PXLnm at regions defined by crossings of a plurality of gate lines GL1 to GLn and a plurality of data lines DL1 to DLm. The pixels PXL11 to PXLnm respectively have TFTs TFT11 to TFTnm for switching pixel voltage signals supplied from data lines DL1 to DLm to liquid crystal cells CLC11 to CLCnm in response to scan signals applied to gate lines GL1 to GLn. The liquid crystal cells CLC11 to CLC1*m* of the pixels PXL11 to PXL1*m* driven by the scan signal applied to the first gate line GL1 are electrically connected to a reference voltage line VLref. The reference voltage line VLref is supplied with a reference voltage Vref. The reference voltage Vref is generated from a reference voltage generator 20 and maintains a constant voltage level. Under control of the timing controller 18, the reference voltage generator 20 may supply the reference voltage line VLref with a reference voltage Vref whose voltage level is varied at each frame. Alternatively, the reference voltage generator 20 may be replaced with a common voltage generator [9] similar to the common voltage generator 9 of the related art LCD. In this case, the common voltage Vcom from the common voltage generator is supplied to the reference voltage line VLref. Further, the reference voltage line VLref may be supplied with the reference voltage Vref from the data driver 16. In this case, the data driver 16 may generate the reference voltage Vref whose voltage level is varied at each frame under control of the timing controller 18.

The liquid crystal cells CLC21 to CLCnm of the pixels PXL21 to PXLnm responsive to the scan signals applied to the gate lines GL2 to GLn are connected between the liquid crystal cells CLC11 to CLC(n−1)m corresponding to the previous gate lines GL1 to GLn−1 and drain terminals of the TFTs TFT21 to TFTnm of the current pixels PXL21 to PXLnm. In other words, the liquid crystal cells CLC21 to CLCnm of the pixels PXL21 to PXLnm responsive to the scan signals of the $2^{nd}$ to $n^{th}$ gate lines GL2 to GLn are connected between the drains of the TFTs TFT11 to TFT(n−1)m of the previous pixels corresponding to the previous gate lines GL1 to GLn−1 and the current TFTs TFT21 to TFTnm of the current pixels. Therefore, the liquid crystal cells CLC arranged along the data lines DL are connected to the reference voltage line VLref in cascade, thereby forming a serial circuit.

The liquid crystal cells CLC11 to CLC1*m* of the pixels PXL11 to PXL1*m* responsive to the scan signals of the first gate line GL1 are charged with difference voltages between the reference voltage Vref of the reference voltage line VLref and the pixel voltage signals of the corresponding data lines DL1 to DLm. Due to the pixel voltage signals of the data lines DL1 to DLm, the liquid crystal cells CLC21 to CLCnm of the pixels PXL21 to PXLnm responsive to the scan signals of the $2^{nd}$ to $n^{th}$ gate lines GL2 to GLn are charged with pixel voltages having one of voltage levels in the positive polarity (+) regions or one of voltage levels in the negative polarity (−) regions with respect to the pixel voltage signals charged at the liquid crystal cells CLC11 to CLC(n−1)m of the pixels PXL11 to PXL(n−1)m on the previous gate lines GL1 to GLn−1, respectively. In other words, the liquid crystal cells CLC21 to CLCnm of the pixels PXL21 to PXLnm responsive to the scan signals of the $2^{nd}$ to $n^{th}$ gate lines GL2 to GLn are charged with pixel voltages higher or lower than the pixel voltage signals charged at the liquid crystal cells CLC11 to CLC(n−1)m of the pixels PXL11 to PXL(n−1)m on the previous gate lines GL1 to GLn−1 by the voltage levels of the pixel signals on the corresponding data lines DL1 to DLm, respectively.

According to the present invention, the liquid crystal cells CLC21 to CLCnm of the liquid crystal panel 12 are charged with the pixel voltages having positive or negative polarity with respect to the voltage charged at the liquid crystal cells CLC11 to CLC(n−1)m of the previous line. Therefore, the swing width of the pixel voltage charged to the liquid crystal cells CLC21 to CLCnm and the swing width of the pixel voltage signal transferred to the data lines DL1 to DLm are reduced. Consequently, the driving power consumption of the liquid crystal panel 12 is minimized and the impulse type noise is reduced.

The gate driver 14 sequentially enables the gate lines GL1 to GLn of the liquid crystal panel 12 in response to a gate timing control signal from the timing controller 18 at each horizontal sync period. When one of the gate lines GL1 to GLn is driven, the data driver 16 supplies the pixel voltage signals to the data lines DL1 to DLm. For this purpose, the data driver 16 is configured to be responsive to a data timing control signal from the timing controller 18. Also, the data driver 16 inputs pixel data for one line from the timing controller 18 at each horizontal sync period, and supplies $1^{st}$ to $m^{th}$ data lines DL1 to DLm with the pixel voltage signals for one line, which have voltage levels corresponding to logic values of the pixel data for one line. The timing controller 18 receives a video data VD and synchronous signals SYNC from an external source(not shown) such as a graphic board of a computer system. The synchronous signals SYNC may include a vertical synchronous signal, a horizontal synchronous signal and a data clock and so on. The video data VD includes red, green and blue pixel data for one frame (or one picture). The timing controller 18 generates the gate control signal and the data control signal on the basis of the synchronous signals SYNC. Also, the timing controller 18 applies the red, green and blue pixel data of the video data VD to the data driver 16 line-by-line.

When the liquid crystal panel 12 is driven by the inversion system, the pixel voltage signals supplied to the $1^{st}$ to $m^{th}$ data lines DL1 to DLm may have voltages that vary in a positive polarity (+) direction or a negative polarity (−) direction with respect to pixel voltage signal of the previous frame or previous horizontal period during each frame period and/or horizontal sync period. Also, the pixel voltage signal may be polarity-inverted according to the change of the data lines DL1 to DLm.

For example, when the liquid crystal panel 12 is driven by a dot inversion system, the pixel voltage signals output to the data lines DL1 to DLm have voltage levels whose polarity is opposite to the pixel voltage signals on the adjacent data lines and also have the voltage levels of positive or negative polarity with respect to the reference voltage Vref on the reference voltage line VLref during the first horizontal period of the frame period. Also, the pixel voltage signals output to the data lines DL1 to DLm have negative or positive voltages with respect to the voltage levels of the previous pixel voltage at each horizontal sync period. Therefore, as illustrated in FIG. 5, the liquid crystal cells CLC11 to CLCnm of the pixels PXL11 to PXLnm on the liquid crystal panel 12 are charged with pixel voltage signals whose polarity is opposite to the liquid crystal cell of the adjacent pixel.

Referring to FIG. 5, due to the pixel voltage signal DVk on the $k^{th}$ data line DLk, the liquid crystal cell CLCjk of the pixel PXLjk connected to the $j^{th}$ gate line GLj and the $k^{th}$ data line DLk is charged with the pixel voltage (that is, the positive pixel voltage) CLCVjk higher than the pixel voltage CLCV(j−1)k, which is charged at the liquid crystal cell CLC(j−1)k of the pixel PXL(j−1)k connected to the $(j-1)^{th}$ gate line GLj−1 and the $k^{th}$ data line DLk, by the voltage level of the pixel voltage signal DVk on the $k^{th}$ data line DLk. Likewise, due to the pixel voltage signal DVk+1 on the $(k+1)^{th}$ data line DLk+1, the liquid crystal cell of the pixel connected to the $(j+1)^{th}$ gate line GLj+1 and the $(k+1)^{th}$ data line DLk+1 is charged with the pixel voltage (that is, the positive pixel voltage) CLCV(j+1)(k+1) higher than the pixel voltage, which is charged at the liquid crystal cell of the pixel connected to the $j^{th}$ gate line GLj and the $(k+1)^{th}$ data line DLk+1, by the voltage level of the pixel voltage signal DVk+1 on the $(k+1)^{th}$ data line DLk+1. On the contrary, due to the pixel voltage signal DVk+1 on the $(k+1)^{th}$ data line DLk+1, the liquid crystal cell CLCj(k+1) of the pixel connected to the $j^{th}$ gate line GLj and the $(k+1)^{th}$ data line DLk+1 is charged with the pixel voltage (that is, the negative pixel voltage) CLCVj(k+1) lower than the pixel voltage, which is charged at the liquid crystal cell CLC(j−1)(k+1) of the pixel PXL(j−1)(k+1) connected to the $(j-1)^{th}$ gate line GLj−1 and the $(k+1)^{th}$ data line DLk+1, by the voltage level of the pixel voltage DVk+1 on the $(k+1)^{th}$ data line DLk+1. Also, due to the pixel voltage signal DVk on the $k^{th}$ data line DLk, the liquid crystal cell CLC(j+1)k of the pixel PXL(j+1)k connected to the $(j+1)^{th}$ gate line GLj+1 and the $k^{th}$ data line DLk is charged with the pixel voltage (that is, the negative pixel voltage) CLCV(j+1)k lower than the pixel voltage, which is charged at the liquid crystal cell CLCjk of the pixel CLCVjk connected to the $j^{th}$ gate line GLj and the $k^{th}$ data line DLk, by the voltage level of the pixel voltage DVk on the $k^{th}$ data line DLk.

Figure 6:
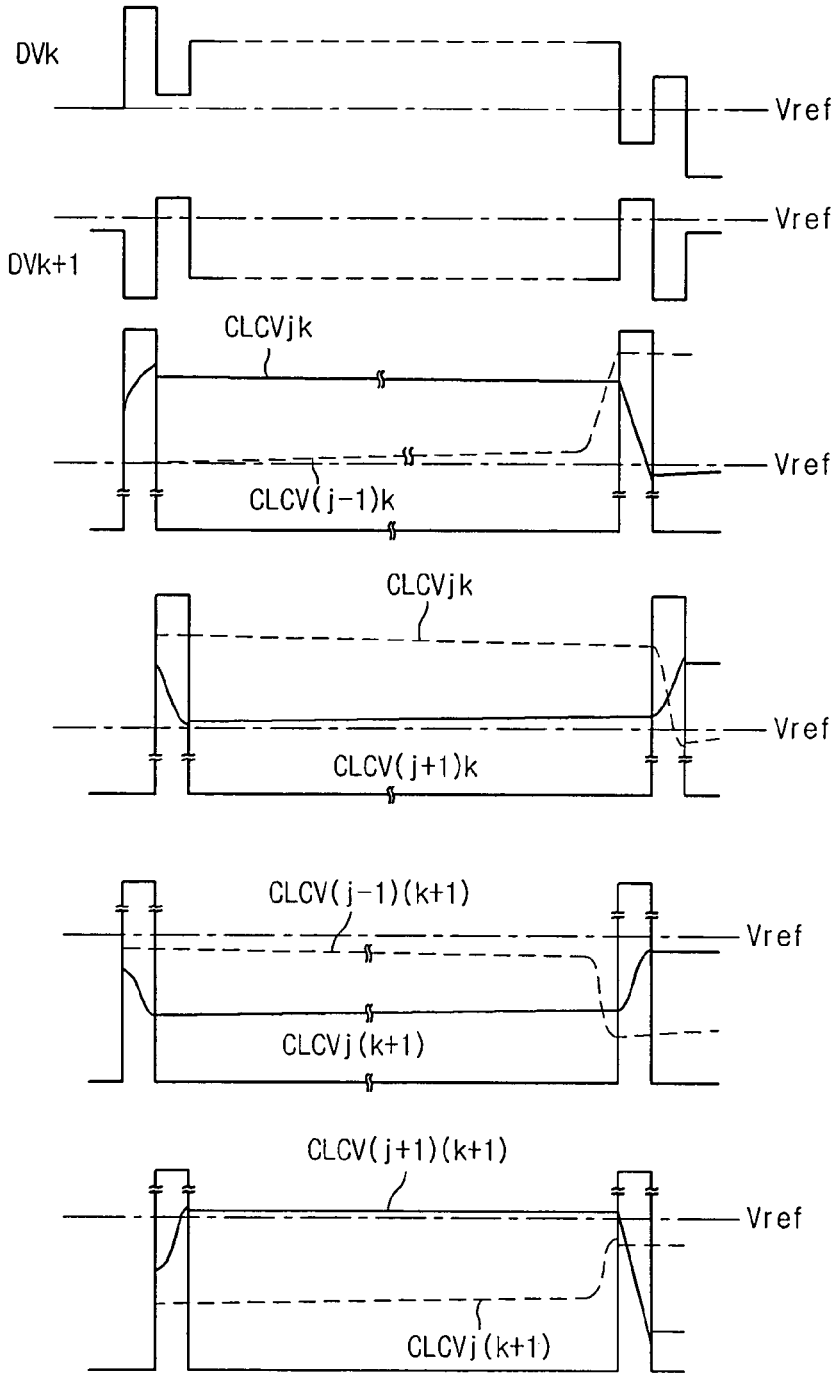
FIG. 6 is a waveform diagram of signals at each part of the LCD according to an embodiment of the present invention when the liquid crystal panel is driven by a dot inversion system.

In order to drive the liquid crystal panel 12 through the polarity patterns of FIG. 5, the data driver 16 supplies the $k^{th}$ and $(k+1)^{th}$ pixel voltage signals DVk and DVk+1 to the $k^{th}$ and $(k+1)^{th}$ data lines DLk and DLk+1, respectively. Referring to FIG. 6, the $k^{th}$ pixel voltage signal DVk has a voltage level increased by a voltage corresponding to a logic value (i.e., a gradation value) of a pixel data with reference to the pixel voltage level of the $(j-1)^{th}$ horizontal sync period during the $j^{th}$ horizontal sync period, that is, by a voltage level changed as much as a voltage corresponding to a logic value of a pixel data in a positive polarity (+) direction, and then has a voltage level decreased by a voltage corresponding to a logic value of a pixel data with reference to the pixel voltage level of the $j^{th}$ horizontal sync period during the $(j+1)^{th}$ horizontal sync period, that is, by a voltage level changed as much as a voltage corresponding to a logic value of a pixel data in a negative polarity (−) direction. Likewise, the $(k+1)^{th}$ pixel voltage signal DVk+1 has a voltage level changed as much as a voltage corresponding to a logic value of a pixel data in a negative polarity (−) direction with reference to a pixel voltage level of the $(j-1)^{th}$ horizontal sync period during the $j^{th}$ horizontal sync period, and then has a voltage level changed as much as a voltage corresponding to a logic value of a pixel data in a positive polarity (+) direction with reference to the pixel voltage level of the $j^{th}$ horizontal sync period during the $(j+1)^{th}$ horizontal sync period.

The TFT TFTjk of the $k^{th}$ pixel PXLjk on the $j^{th}$ gate line GLj is turned on in response to the scan signal GLSj of a high level on the $j^{th}$ gate line GLj, so that the pixel voltage signal DVk on the $k^{th}$ data line DLk is supplied to the corresponding liquid crystal cell CLCjk. Therefore, the $k^{th}$ liquid crystal cell CLCjk of the $j^{th}$ gate line GLj is charged with the pixel voltage signal DVk from the $k^{th}$ data line DLk. Consequently, the $k^{th}$ liquid crystal cell CLCjk on the $j^{th}$ gate line GLj is charged with the pixel voltage (that is, the positive pixel voltage) CLCVjk higher than the pixel voltage CLCV(j−1)k, which is charged at the corresponding liquid crystal cells CLC(j−1)k of the previous gate line GLj−1, by a voltage level of the pixel voltage signal DVk of the $k^{th}$ data line DLk. Likewise, the TFT TFTj(k+1) of the $(k+1)^{th}$ pixel on the $j^{th}$ gate line GLj is turned on in response to the scan signal GLSj of a high level on the $j^{th}$ gate line GLj, so that the pixel voltage signal DVk+1 on the $(k+1)^{th}$ data line DLk+1 is supplied to the corresponding liquid crystal cell CLCj(k+1). Therefore, the $(k+1)^{th}$ liquid crystal cell CLCj(k+1) of the $j^{th}$ gate line GLj is charged with the pixel voltage signal DVk+1 from the $(k+1)^{th}$ data line DLk+1. Consequently, the $(k+1)^{th}$ liquid crystal cell CLCj(k+1) on the $j^{th}$ gate line GLj is charged with the pixel voltage (that is, the negative pixel voltage) CLCVj(k+1) lower than the pixel voltage CLCV(j−1)(k+1), which is charged at the corresponding liquid crystal cell CLC(j−1)(k+1) of the previous gate line GLj−1, by a voltage level of the pixel voltage signal DVk+1 of the $(k+1)^{th}$ data line DLk+1.

Also, the TFT TFT(j+1)k of the $k^{th}$ pixel PXL(j+1)k on the $(j+1)^{th}$ gate line GLj+1 is turned on in response to the scan signal GLSj+1 of a high level on the $(j+1)^{th}$ gate line GLj+1, so that the pixel voltage signal DLVk on the $k^{th}$ data line DLk is supplied to the corresponding liquid crystal cell CLC(j+1)k. Therefore, the $k^{th}$ liquid crystal cell CLC(j+1)k of the $(j+1)^{th}$ gate line GLj+1 is charged with the pixel voltage signal DLVk from the $k^{th}$ data line DLk. Consequently, the $k^{th}$ liquid crystal cell CLC(j+1)k on the $(j+1)^{th}$ gate line GLj+1 is charged with the pixel voltage (that is, the negative pixel voltage) CLCV(j+1)k lower than the pixel voltage CLCVjk, which is charged at the corresponding liquid crystal cell CLCjk of the previous gate line GLj, by a voltage level of the pixel voltage signal DVk of the $k^{th}$ data line DLk. Likewise, the TFT TFT(j+1)(k+1) of the $(k+1)^{th}$ pixel PXL(j+1)(k+1) on the $(j+1)^{th}$ gate line GLj+1 is turned on in response to the scan signal GLSj+1 of a high level on the $(j+1)^{th}$ gate line GLj+1, so that the pixel voltage signal DVk+1 on the $(k+1)^{th}$ data line DLk+1 is supplied to the corresponding liquid crystal cell CLC(j+1)(k+1). Therefore, the $(k+1)^{th}$ liquid crystal cell CLC(j+1)(k+1) of the $(j+1)^{th}$ gate line GLj+1 is charged with the pixel voltage signal DVk+1 from the $(k+1)^{th}$ data line DLk+1. Consequently, the $(k+1)^{th}$ liquid crystal cell CLC(j+1)(k+1) on the $(j+1)^{th}$ gate line GLj+1 is charged with the pixel voltage (that is, the negative pixel voltage) CLCV(j+1)(k+1) lower than the pixel voltage CLCVj(k+1), which is charged at the corresponding liquid crystal cell CLCj(k+1) of the previous gate line GLj, by a voltage level of the pixel voltage signal DVk+1 of the $(k+1)^{th}$ data line DLk+1.

In this manner, each liquid crystal cell included in the pixels of the liquid crystal panel 12 is charged with pixel voltage higher or lower than the pixel voltage, which is charged in the liquid crystal cell of the previous line, by the voltage level of the pixel voltage signal on the corresponding data line. Therefore, the swing width of the pixel voltage at the liquid crystal cells and the swing width of the pixel voltage signal supplied to each data line DL are reduced. Consequently, the liquid crystal panel 12 and the LCD having the same according to the present invention can reduce the driving power consumption and suppress the occurrence of impulse type noise.

Figure 7:
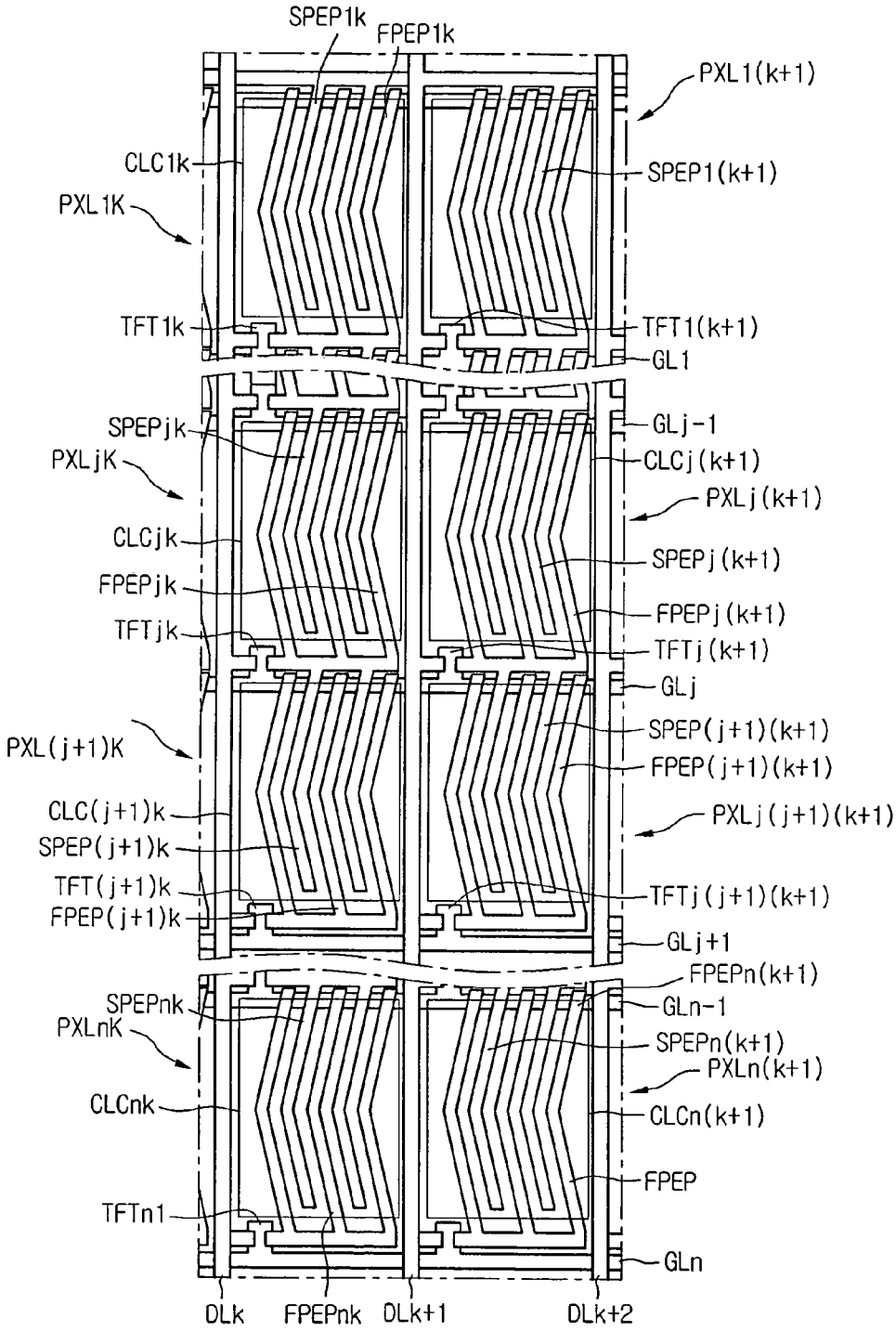
FIG. 7 is a layout of the liquid crystal panel of FIG. 4 according to an embodiment of the present invention.

FIG. 7 is a layout of the liquid crystal panel 12 of FIG. 4 according to an embodiment of the present invention. Although pixels connected to three data lines DLk−1 to DLk+1 are illustrated, it will be apparent to those skilled in the art that n×m number of pixels PXL11 to PXLnm connected to m number of data lines DL1 to DLm can be included in the liquid crystal panel 12 according to the embodiment of the present invention. Accordingly, n×m number of pixels PXL11 to PXLnm will be described in FIG. 7.

Referring to FIG. 7, the liquid crystal panel 12 includes a plurality of pixels PXL11 to PXLnm at regions defined by a plurality of gate lines GL1 to GLn and a plurality of data lines DL1 to DLm. The pixels PXL11 to PXLnm have TFTs TFTs11 to TFTnm connected to the gate lines GL1 to GLn and the data lines DL1 to DLm, respectively. The pixels PXL21 to PXLnm connected to the $2^{nd}$ and $n^{th}$ gate lines GL2 to GLn further include liquid crystal cells CLC11 to CLC(n−1)m connected between the TFT transistors TFT21 to TFTnm and the drains of the TFTs TFT11 to TFT(n−1)m connected to the previous gate lines GL1 to GLn−1, respectively. The pixels PXL11 to PXLnm connected to the first gate line GL1 further include liquid crystal cells CLC11 to CLC1*m* connected between the reference voltage line VLref and the drains (that is, the liquid crystal cells CLC21 to 2*m*) of the TFTs TFT11 to TFT1*m* connected to the first gate line GL1, respectively.

The liquid crystal cells CLC 11 to CLCnm include first pixel electrode patterns FPEP11 to FPEPnm electrically connected to the drains of the corresponding TFTs and the liquid crystal cells of the next line, and second electrode patterns SPEP11 to SPEPnm connected to the drains of the TFTs of the reference voltage line Vref or the previous line and the corresponding liquid crystal cells, respectively. The first and second pixel electrode patterns FPEP and SPEP are formed in a comb shape. Also, the comb-shaped first and second pixel electrode patterns FPEP are alternately arranged in the pixel regions.

For example, the liquid crystal cell CLCjk of the pixel PXLjk driven by the $j^{th}$ gate line GLj and the $k^{th}$ data line DLk is connected between the liquid crystal cell CLC(j−1)k of the $k^{th}$ pixel PXLk on the $(j-1)^{th}$ gate line GLj−1 and the liquid crystal cell CLC(j+1)k of the $k^{th}$ pixel PXLk on the $(j+1)^{th}$ gate line GLj+1. In other words, the liquid crystal cell CLCjk of the pixel PXLjk driven by the $j^{th}$ gate line GLj and the $k^{th}$ data line DLk is connected between the drain of the $k^{th}$ TFT TFT(j−1)k connected to the $(j-1)^{th}$ gate line GLj−1 and the drain of the TFT TFTjk connected to the $j^{th}$ gate line GLj.

Meanwhile, the first pixel electrode patterns FPEP11 to FPEP1*m* of the liquid crystal cells on the first line is electrically connected to the drains of the TFTs TFT11 to TFT1*m* on the first gate line GL1, and to the second pixel electrode patterns SPEP21 to SPEP2*m* of the liquid crystal cells CLC21 to CLC2*m* on next line. On the contrary, the second pixel electrode patterns SPEP11 to SPEP1*m* of the liquid crystal cells CLC11 to CLC1*m* on the first line are connected to the reference voltage line VLref. The comb-shaped first and second pixel electrode patterns FPEP and SPEP are alternately arranged in the pixel regions.

Consequently, the drains of the TFTs TFT11 to TFT(n−1)m connected to the $2^{nd}$ to $(n-1)^{th}$ gate lines GL1 to GLn−1 are electrically connected to the first pixel electrode patterns FPEP11 to FPEP(n−1)m formed in the pixel regions to be driven by the gate lines GL1 to GLn−1, and the second pixel electrode patterns SPEP21 to SPEPnm formed in the pixel regions to be driven by the next gate lines GL2 to GLn, respectively. The second pixel electrode patterns SPEP11 to SPEP1*m* of the liquid crystal cells CLC11 to CLC1*m* to be driven by the first gate line GL1 are electrically connected to the reference voltage line VLref. The drains of the TFTs TFTn1 to TFTnm to be driven by the $n^{th}$ gate line GLn are electrically connected to the first pixel electrode patterns FPEPn1 to FPEPnm formed in the corresponding pixel regions.

In the liquid crystal panel 12 of the present invention, the two pixel electrode patterns of the liquid crystal cells are electrically connected to the pixel electrode patterns of the liquid crystal cells of the previous line and the next line, which are arranged adjacently along the data line DL, and the liquid crystal cells are serially connected to the reference voltage line VLref. When the serially-connected liquid crystal cells are charged with positive or negative pixel voltages with reference to the pixel voltage of the liquid crystal cells of the previous line, the swing width of the charged pixel voltage is reduced. Therefore, the driving power consumption of the liquid crystal panel 12 is reduced and the impulse type noise is suppressed.

As described above, the liquid crystal cells of the pixels are charged with pixel voltages (that is, positive and negative pixel voltages) higher or lower than the pixel voltage signal of the corresponding data line with reference to the charged pixel voltages. Therefore, the swing width of the pixel voltage at the liquid crystal cells, the swing width of the pixel voltage supplied to the data lines DL, and the swing width of the pixel voltage signal supplied to the data lines are reduced. Consequently, the driving power consumption in both the liquid crystal panel and the LCD having the same can be reduced and the pulse type noise can be suppressed.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A liquid crystal panel comprising:

a plurality of gate lines;

a plurality of data lines defining pixel regions at crossings of the gate lines; and a plurality of pixels at regions defined by crossings of the plurality of gate lines and the plurality of data lines, wherein the plurality of pixels include first pixels defined by crossings of a first gate line of the plurality of gate lines and the plurality of data lines and second pixels defined by crossing of remaining gate lines of the plurality of gate lines and the plurality of data lines, wherein the first pixels include liquid crystal cells with an electrode directly connected to a reference voltage line and a drain electrode of a thin film transistor connected to the first gate line, wherein the second pixels include liquid crystal cells connected between a thin film transistor connected to the remaining gate lines and a drain electrode of the thin film transistor connected to the previous gate lines, wherein the liquid crystal cells of the first pixels arranged along the data lines are serially connected to the reference voltage line, wherein the liquid crystal cells of the second pixels arranged along the data lines are connected to the reference voltage line in cascade, thereby forming a serial circuit, wherein a reference voltage is supplied to the reference voltage line from a reference voltage generator, wherein a level of the reference voltage is varied at each frame, wherein the liquid crystal cells of the first pixels are charged with difference voltages between the reference voltage and a pixel voltage signal of the corresponding data lines.

2. The liquid crystal panel according to claim 1, wherein the liquid crystal cells of the second pixels are alternately charged with pixel voltages having positive polarity and negative polarity with reference to a voltage charged at the previous liquid crystal cell.

3. The liquid crystal panel according to claim 1, wherein each of the liquid crystal cells of the second pixels comprises:

a first pixel electrode pattern connected to a previous liquid crystal cell; and a second pixel electrode pattern connected to a next liquid crystal cell.

4. The liquid crystal panel according to claim 3, wherein the first and second pixel electrode patterns have comb shapes.

5. The liquid crystal panel according to claim 4, wherein the comb-shaped first and second pixel electrode patterns are alternately arranged.

6. A liquid crystal display device comprising:

a liquid crystal panel including a plurality of gate lines, a plurality of data lines defining pixel regions at crossings of the gate lines and a plurality of pixels at regions defined by crossings of the plurality of gate lines and the plurality of data lines;

a gate driver sequentially driving the plurality of gate lines arranged on the liquid crystal panel;

a data driver supplying a second pixel voltage signal to data lines of the liquid crystal panel when a next gate line of the plurality of gate lines is driven, the second pixel voltage signal being based on a first pixel voltage signal when a previous gate line of adjacent gate lines is driven as a reference voltage; and a reference voltage generator supplying a reference voltage to a reference voltage line, wherein a level of the reference voltage is varied at each frame by control of a timing controller, wherein the plurality of pixels include first pixels defined by crossings of a first gate line of the plurality of gate lines and the plurality of data lines and second pixels defined by crossing of remaining gate lines of the plurality of gate lines and the plurality of data lines, wherein the first pixels include liquid crystal cells with an electrode directly connected to the reference voltage line and a drain electrode of a thin film transistor connected to the first gate line, wherein the second pixels include liquid crystal cells connected between a thin film transistor connected to the remaining gate lines and a drain electrode of the thin film transistor connected to the previous gate lines, wherein the liquid crystal cells of the first pixels arranged along the data lines are serially connected to the reference voltage line, wherein the liquid crystal cells of the second pixels arranged along the data lines are connected to the reference voltage line in cascade, thereby forming a serial circuit, wherein the liquid crystal cells of the first pixels are charged with difference voltages between the reference voltage and a pixel voltage signal of the corresponding data lines.

7. The liquid crystal display device according to claim 6, wherein the second pixel voltage signal has a difference voltage corresponding to a logic value of pixel data compared with the first pixel voltage signal.

8. The liquid crystal display device according to claim 6, wherein the second pixel voltage signal is alternatively higher and lower than the first pixel voltage signal.

9. A driving method of a liquid crystal display device, comprising:

sequentially driving a plurality of gate lines arranged on a liquid crystal panel;

supplying a first pixel voltage signal of a previous gate line adjacent the plurality of gate lines to data lines arranged on the liquid crystal panel; and supplying a second pixel voltage signal to the data lines when a next gate line of the plurality of gate lines is driven, the second pixel voltage being based on the first pixel voltage as a reference voltage, wherein the liquid crystal panel includes the plurality of gate lines, the plurality of data lines defining pixel regions at crossings of the gate lines and a plurality of pixels at regions defined by crossings of the plurality of gate lines and the plurality of data lines, wherein the plurality of pixels include first pixels defined by crossings of a first gate line of the plurality of gate lines and the plurality of data lines and second pixels defined by crossing of remaining gate lines of the plurality of gate lines and the plurality of data lines, wherein the first pixels include liquid crystal cells with an electrode directly connected to a reference voltage line and a drain electrode of a thin film transistor connected to the first gate line, wherein the second pixels include liquid crystal cells connected between a thin film transistor connected to the remaining gate lines and a drain electrode of the thin film transistor connected to the previous gate lines, wherein the liquid crystal cells of the first pixels arranged along the data lines are serially connected to the reference voltage line, wherein the liquid crystal cells of the second pixels arranged along the data lines are connected to the reference voltage line in cascade, thereby forming a serial circuit, wherein a reference voltage is supplied to the reference voltage line from a reference voltage generator, wherein a level of the reference voltage is varied at each frame, wherein the liquid crystal cells of the first pixels are charged with difference voltages between the reference voltage and a pixel voltage signal of the corresponding data lines.

10. The driving method according to claim 9, wherein the second pixel voltage signal has a difference voltage corresponding to a logic value of pixel data compared with the first pixel voltage signal.

11. The driving method according to claim 9, wherein the second pixel voltage signal is alternatively higher and lower than the first pixel voltage signal.

* * * * *